US008360670B2

(12) United States Patent
Zahn

(10) Patent No.: US 8,360,670 B2
(45) Date of Patent: Jan. 29, 2013

(54) PEN-LIKE APPLICATOR

(75) Inventor: Werner Zahn, Geroldsgrün (DE)

(73) Assignee: Faber-Castell AG, Stein (DE)

( * ) Notice: Subject to any disclaimer, the term of this patent is extended or adjusted under 35 U.S.C. 154(b) by 0 days.

(21) Appl. No.: 13/245,999

(22) Filed: Sep. 27, 2011

(65) Prior Publication Data

US 2012/0070221 A1 Mar. 22, 2012

Related U.S. Application Data

(63) Continuation of application No. PCT/EP2010/051405, filed on Feb. 5, 2010.

(30) Foreign Application Priority Data

Mar. 27, 2009 (DE) ..... 10 2009 001 927

(51) Int. Cl.
*B43K 5/00* (2006.01)

(52) U.S. Cl. ..... 401/202; 401/269

(58) Field of Classification Search ..... 401/202, 401/213, 243, 262, 269, 158, 159; 222/153.1, 222/153.13, 153.14
See application file for complete search history.

(56) References Cited

U.S. PATENT DOCUMENTS

| | | | | |
|---|---|---|---|---|
| 3,655,290 | A * | 4/1972 | Griffith | 401/186 |
| 4,722,459 | A | 2/1988 | Goncalves | |
| 7,281,876 | B2 * | 10/2007 | Kwon | 401/265 |

FOREIGN PATENT DOCUMENTS

| | | | |
|---|---|---|---|
| DE | 35 45 876 | A1 | 8/1986 |
| DE | 35 45 876 | C2 | 8/1986 |
| EP | 0 214 012 | A1 | 3/1987 |
| EP | 0 214 012 | B1 | 3/1987 |
| GB | 2170999 | A | 8/1986 |

* cited by examiner

*Primary Examiner* — David Walczak
(74) *Attorney, Agent, or Firm* — Laurence A. Greenberg; Werner H. Stemer; Ralph E. Locher

(57) ABSTRACT

A pen-like applicator contains a pen shaft having a removable cap at a first end and at the other, second end, a delivery button that acts upon a reservoir for application fluid. A protective device while being in a protected position, protects the delivery button from being actuated when the cap is on and being coupled to the movement of the cap in a way, such that the protective device is in a release position that releases the delivery button for actuation when the cap is removed.

13 Claims, 9 Drawing Sheets

73
60
58
78
94
56
90
86
98
14
18
14
30

4
30

92
48

FIG. 11
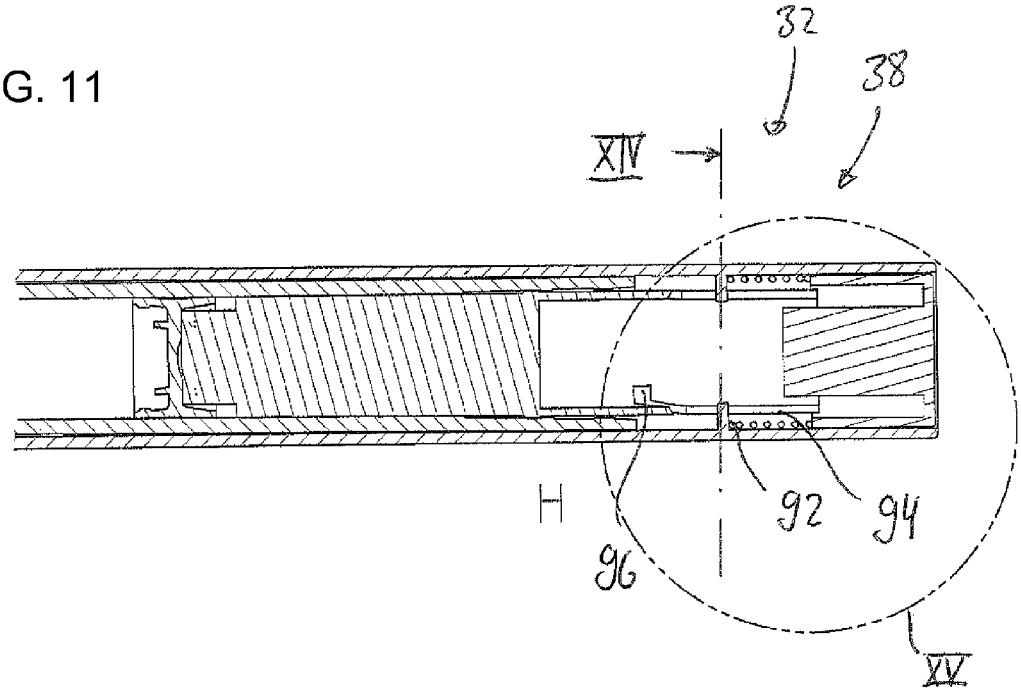
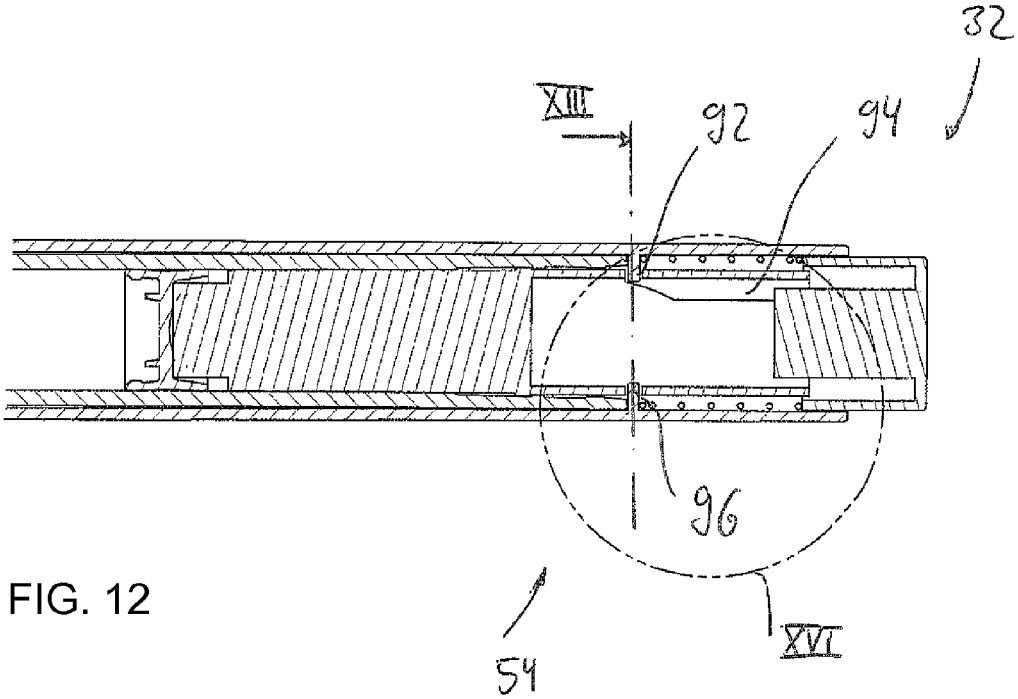
FIG. 12

98
30
b)
18
48
94
92
4
74
44
a)
90
48
30
4
92
96
18

94
92
48
30

48
30
94
96
92

FIG. 15
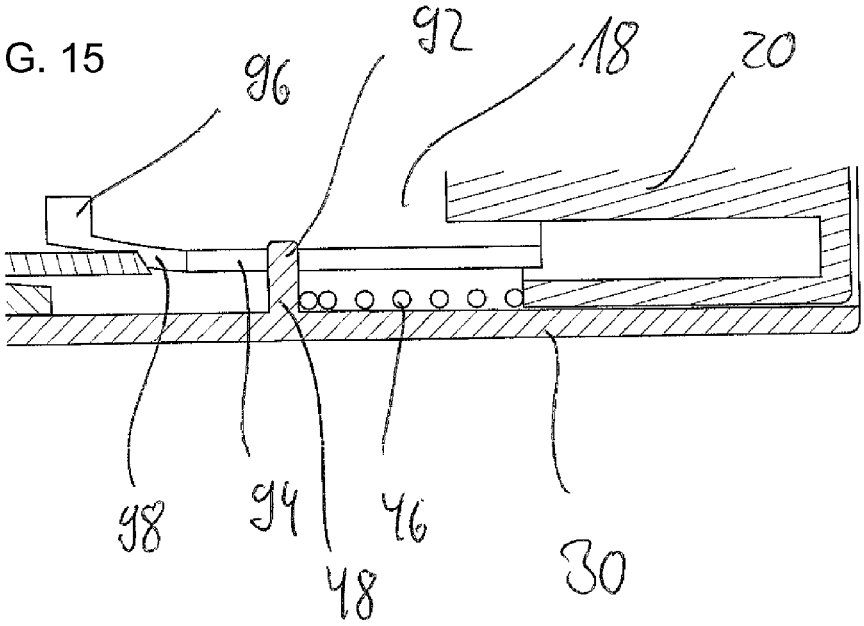
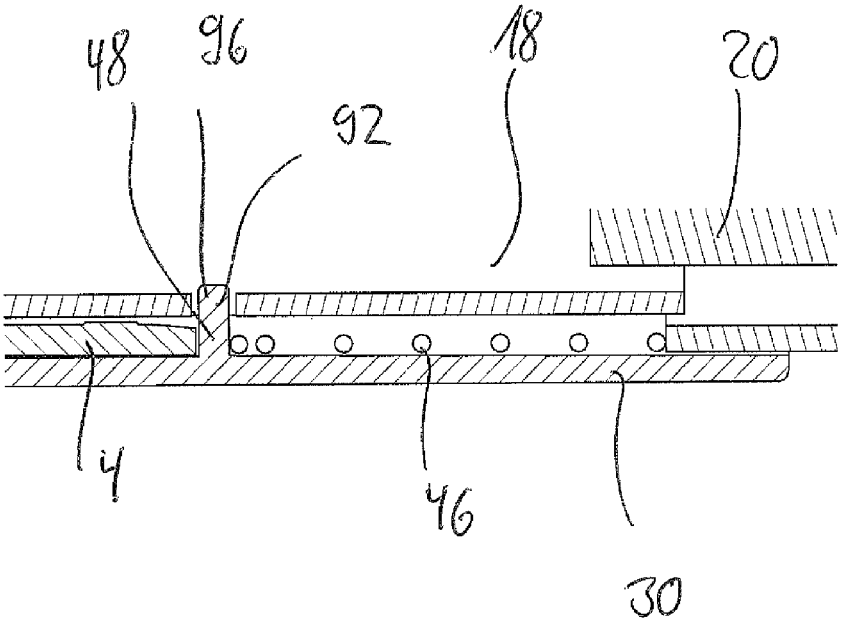
FIG. 16

PEN-LIKE APPLICATOR

CROSS-REFERENCE TO RELATED APPLICATION

This is a continuation application, under 35 U.S.C. §120, of copending international application No. PCT/EP2010/051405, filed Feb. 5, 2010, which designated the United States; this application also claims the priority, under 35 U.S.C. §119, of German patent application No. DE 10 2009 001 927.8, filed Mar. 27, 2009; the prior applications are herewith incorporated by reference in their entireties.

BACKGROUND OF THE INVENTION

Field of the Invention

The invention relates to a pen-like applicator.

A pen-like applicator of the type in question has a pen shaft that carries at its first axial end an applicator tip. When the applicator is not in use, this end is closed off by a cap which may be removed for use. Typically, this is a threaded screw cap which securely seals off the applicator. At its other, second end the applicator carries a delivery button. Actuating the delivery button has the effect of delivering application fluid from a reservoir in the pen shaft to the applicator tip for application from that point. Press action buttons or twist buttons are for example known as delivery buttons. Applicators of this kind are known, for example in the cosmetics sector, from European application EP 0 214 012 A1 (corresponding to U.S. Pat. No. 4,722,459) or as liquid applicators for the application of nail varnish as an application fluid, from German patent application DE 10 2008 041 282 (corresponding to U.S. patent publication No. 020100040404) or German patent DE 10 2008 043 911.

In the case of a press action button, the applicator is held by the pen shaft and axial pressure is exerted on the delivery button, for example by a thumb, whereupon a precisely definable small quantity of nail varnish reaches the applicator tip. In this case, the press action button has the advantage of one-handed operation. In the case of a twist button, the delivery button is held for example between the thumb and index finger and rotated in the peripheral direction. Dosing within the pen is performed for example by way of a twist ratchet mechanism. This enables very fine dosing, as a function of the pitch of the internal delivery thread. As an alternative, a press action mechanism is also possible.

The applicator may be provided with a weight. Shaking the applicator causes the weight to move to and fro in the axial direction, as a result of which a wire connected to the weight cleans off fluid residues, which arise from drying on, from internal channels—for example tubes leading to the applicator tip. A weight of this kind is known for example from technical pens from Faber-Castell.

By comparison with known nail varnish bottles, the applicator has the advantage of simpler handling. There is no need for a brush to be separately dipped in a reservoir. As a result, the user runs a smaller risk of soiling, and moreover the separate operation of wiping off the brush is dispensed with. A precisely dosable piston mechanism that acts on the reservoir makes it possible to apply a desired quantity of application fluid cleanly and precisely. The applicator offers substantially better hygiene, since once the applicator has been used it does not need to be dipped in the nail varnish reservoir again for another application or for storage.

The disadvantage in the case of known applicators is that the delivery button can be actuated inadvertently, for example during transport in a purse or jacket pocket—in particular in the case of a press action mechanism. In this way, application fluid emerges toward the applicator tip and is distributed, for example in the pen cap, and soils the latter or clogs it up, and application fluid is wasted.

SUMMARY OF THE INVENTION

It is accordingly an object of the invention to provide a pen-like applicator which overcomes the above-mentioned disadvantages of the prior art devices of this general type, which specifies an improved pen-like applicator.

With the foregoing and other objects in view there is provided, in accordance with the invention a pen-like applicator. The applicator contains a pen shaft having a first end and a second end. The pen shaft functions as a reservoir for an application fluid. A removable cap is disposed at the first end. A delivery button is disposed at the second end. A protective device that, when the removable cap is placed on, is disposed in a protective position and prevents the delivery button from being actuated and whereof movement is coupled to that of the removable cap such that when the removable cap is removed the protective device is in a release position in which the protective device releases the delivery button for actuation.

The invention is based on the realization that in the case of the known applicators the press action or twist mechanism is always unprotected and thus actuable. The invention is based on the basic idea of protecting the delivery button to prevent inadvertent actuation when the pen is not in use, and further on the realization that when it is not in use the cap should always be placed on the applicator. It is therefore the basic idea of the invention to couple the placing on of the cap with a protective device by a movement-coupling mechanism such that the protective device is activated when the cap is placed on, that is to say that the delivery button is prevented from being actuated inadvertently. When the cap is removed, the protective device is in turn moved, and the delivery button is released for actuation. These measures improve the applicator in respect of its reliability of use.

The object is achieved by a pen-like applicator having a pen shaft, in which the pen shaft has at its first axial end a removable cap. In the placed-on condition, the latter covers an applicator tip. Removing the cap releases the applicator tip for use. At its second axial end, the pen shaft has a delivery button. As explained above, the delivery button acts on a reservoir for application fluid for delivery of the latter to the applicator tip when necessary. The applicator has a protective device that, when the cap is placed on, is located in a protective position and in this position prevents the delivery button from being actuated. Movement of the protective device is coupled to that of the cap such that when the cap is removed the protective device is in a release position in which it releases the delivery button for actuation.

Thus, the protective device is movable between two positions, namely the release position and the protective position, in which movement is caused by removal of the cap or the placing of the cap on the applicator. It is thus always ensured that when the applicator is used—when the cap is necessarily removed to release the applicator tip—the protective device is in the release position and the delivery button can be operated for use of the applicator. On the other hand, once use is finished, when the cap is typically placed on again to cover the applicator tip, at the same time the protective device moves back into the protective position and prevents the delivery button from being actuated inadvertently.

Any mechanical devices that prevent the delivery button from being actuated are conceivable as the protective device. There may be mentioned, purely by way of example: bolts, pins or other clamping or blocking means that may retract into the delivery button, which are supported for example on the pen shaft, or covers, caps or sheaths that may extend out of the pen shaft, for complete or partial covering or encasing of the delivery button.

In a particularly simple and hence low-cost and rugged embodiment of the applicator, the protective device contains a sheath that may be displaced in the axial direction of the applicator. In the protective position, this sheath surrounds the delivery button concentrically. In the release position, the sheath is retracted in relation to the pen shaft toward the first end, as a result of which the delivery button projects in the axial direction beyond the sheath and so may be operated.

In other words, therefore, when the cap is unscrewed the delivery button, which was initially in a position recessed into the sheath, is released. When the cap is placed on, the delivery button is recessed into the sheath again, such that inadvertent actuation is prevented. When the closure cap is placed on, therefore, the delivery button is arranged inside the space occupied by the applicator and so it is not readily accessible for actuation. When the closure cap is removed, the delivery button reaches its position of use, in which it projects out of the rear shaft end. The automatic nature of this operation is achieved by the mechanical coupling between the movement of placing on and removing the closure cap and the relative movement between the delivery button and the sheath or pen shaft.

A further embodiment is particularly suitable in conjunction with an axially actuable delivery button. In this case, the delivery button has an actuating surface on its end face. In this case the sheath has an abutment surface on its end face, and this faces the second end and, in the protective position, is located axially in the region of the actuating surface.

If an article that is for example in a purse, together with the applicator, is inadvertently pressed against the second end of the applicator, where the delivery button is located, in the case of the known applicator the article would press in the actuating surface on the end face in the axial direction. Because the protective device is in the protective position, however, the article abuts against the abutment surface on the end face, and for this reason the delivery button is actuated in the axial direction only slightly—if indeed at all—but this does not result in the transport of application fluid. In the release position, in the event of intentional operation by the thumb of a user, for example, the abutment surface is retracted toward the first end, as a result of which the actuating surface on the end face is released and the delivery button may be actuated.

In a preferred variant on this embodiment, in the protective position, that is when the cap is placed on, the sheath extends axially from the cap to the second end of the applicator. Thus, the sheath extends over almost the entire length of the pen shaft. This has the advantage that the applicator has a unitary external appearance; for example, when the cap is placed on it ends such that there is more or less no gap between it and the sheath. Moreover, the additional outer sheath extending over the pen shaft provides an additional protection of the pen shaft, or an additional barrier to permeation for the reservoir in the pen shaft and the application fluid therein containing solvent.

In other words, the sheath then forms the actual or the outer pen shaft by which the applicator is held. The delivery mechanism and the reservoir are located inside the pen shaft, as a cartridge. The double housing wall that is consequently formed provides an effective means of preventing the application fluid from drying out. Depending on the type of fluid—for example whether it is hydrophilic or hydrophobic—a particular mix of materials for the pen shaft and the sheath may be advantageous.

In a further embodiment, a locking device is provided. When the locking device is located in a fixing position, it axially fixes the sheath and the pen shaft to one another. In the release position of the locking device, the sheath and the pen shaft are movable in relation to one another. This axial fixing is important for delivery buttons that are operated by axial press action, since in the event of not being locked or fixed, pressure on the delivery button, which is in communication with the pen shaft, would press the pen shaft and the delivery button into the sheath, with the result that no actuating force would be produced between the delivery button and the pen shaft. For this reason, the pen shaft must be axially fixed to the sheath so that pressure on the delivery button results in a relative movement between the delivery button and the pen shaft when the applicator is held by the sheath, for example in the hand.

Once again, for locking devices a plurality of variants are available. Here, there may be mentioned, purely by way of example: pins, hooks, latching or snap-in devices that may be inserted between the sheath and the pen shaft and which may be released and locked manually or automatically. In this context, automatic means that these are also operated by coupled movement on removal or placing on of the cap.

In a preferred embodiment, the sheath is resiliently pre-tensioned in relation to the pen shaft toward the first end of the cap, that is to say away from the delivery button. This means that without the action of any external force the sheath always slides into the release position and must be brought into the protective position by the action of the cap in opposition to the spring force. For this purpose, the cap and the pen shaft are threaded. When the cap is twisted onto the applicator, the thread engages. Opposing abutment surfaces on the cap and the sheath convert the screwing movement of the cap into an axial movement of the sheath. In this way, the sheath is displaced toward the second end. The first abutment surface is located at the open end of the cap. The second abutment surface, which cooperates therewith, is located at the end of the sheath that faces the cap.

In other words, when the cap is put on it is supported at its end face against the sheath, which is held for example in the hand. The thread engagement between the cap and the pen shaft has the effect of retracting the latter, with the delivery button, into the cap, as a result of which the delivery button disappears inside the sheath.

In a particularly preferred embodiment, the above-mentioned pre-tension is generated by a spring that is supported between the delivery button and the sheath. In particular for press-action operated delivery buttons, the spring has a dual action: when the cap is screwed on and unscrewed, it displaces the sheath and the pen shaft. In the release position, with the sheath axially fixed in relation to the pen shaft, it provides resilience for the press action button in relation to the sheath and the pen shaft.

In a particularly preferred embodiment, the condition of the locking device is variable as a result of twisting the pen shaft and the sheath mutually or in relation to one another. By twisting about the longitudinal axis of the applicator, it can thus attain or abandon the fixing position. Thus, the sheath and the pen shaft are lockable and releasable by this rotation. This rotary movement can easily be combined with the rotary movement when the cap is screwed onto the applicator, with the result that screwing the cap onto the sheath automatically locks the locking device, and unscrewing releases it automatically.

For this reason, in a preferred embodiment the above-mentioned rotary movement that brings about and releases the fixing is caused by a frictional connection means between the cap and the pen shaft. This may be achieved for example by a seal which is mounted on the cap or on the pen shaft and abuts closely against the pen shaft and, when the cap is rotated, entrains the pen shaft in the respective direction of rotation by friction. It is also possible for the thread to take a form with corresponding frictional action in order to exert an entraining rotary movement on the pen shaft.

In a first preferred embodiment, the locking device contains an intermediate floor, which is arranged on the sheath and projects radially inward, and a locking web which is arranged on the pen shaft. Over a particular angular region of its periphery, the intermediate floor has an aperture through which the locking web can pass through the intermediate floor. In the rest of its peripheral region, the intermediate floor acts as an abutment ring. Thus, the sheath and the pen shaft can only be displaced axially in relation to one another in this position of relative rotation. At other angles of rotation, the locking web is supported against the intermediate floor, providing fixing. Thus, changing the position of rotation between the sheath and the pen shaft can fix or release the locking device.

In a preferred embodiment, the locking web has a latching nose. The part of the locking web having the latching nose has the capacity to yield resiliently radially inward, and takes the form of a free end of the locking web. Moreover, the locking web has a ramp, which faces the second end, for the latching nose to run up, and this cooperates with the intermediate floor. The run-up ramp consequently helps the latching nose to pass over the intermediate floor when the locking device moves into the fixing position. This has the advantage that, with the help of the run-up ramp, the locking web can slide over the intermediate floor in any rotary position between the sheath and the pen shaft, and in so doing yields resiliently radially inward. Once the sheath has attained the release position, the locking web yields resiliently radially outward and comes into fixing engagement with the abutment ring, in the manner of a latching nose. However, the reverse movement, back into the protective position, can only be performed if the sheath and the pen shaft are in the correct rotary position in relation to one another and the locking web can pass through the aperture.

In an alternative embodiment, the locking device takes a form such that the sheath has a radially inwardly projecting guide pin that engages in a control cam, which is formed on the pen shaft. The control cam includes a transverse section, which faces the first end, and an axial section, which faces the second end. In other words, this embodiment contains a slot-type guide in which the control cam forms for example a slot in a wall of the pen shaft. Thanks to the axial section running in the axial direction, the sheath may be displaced axially in relation to the pen shaft. If in the release position the guide pin then moves into the transverse section, which runs in the peripheral direction, the sheath may be twisted in relation to the pen shaft far enough for the guide pin and hence the sheath to be fixed axially on the pen shaft.

Here too—as described above—the rotary movement and axial movement may be brought about by a corresponding frictional connection between the cap and the pen shaft or by threaded engagement, for example in conjunction with the above-mentioned spring.

It goes without saying that the control cam may also be mounted on the sheath and the guide pin on the pen shaft. The same applies to a reversal of the intermediate floor and the locking web for the above-mentioned embodiment.

In a further embodiment, the control cam has an oblique section that lies between the axial section and the transverse section. When the cap is placed on or unscrewed, this oblique section creates the bridge between the axial movement and peripheral movement between the pen shaft and the sheath, and the guide pin and the slot-type guide.

Other features which are considered as characteristic for the invention are set forth in the appended claims.

Although the invention is illustrated and described herein as embodied in a pen-like applicator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 11 is a diagrammatic, sectional view showing the applicator from FIG. 10 in section, with the protective device in the protective position;

FIG. 12 is a diagrammatic, sectional view showing the applicator from FIG. 10 with the protective device in a release position;

FIG. 15 is a diagrammatic, sectional view showing detail XV from FIG. 11;

FIG. 16 is a diagrammatic, sectional view showing detail XVI from FIG. 12.

DETAILED DESCRIPTION OF THE INVENTION

Figure 1:
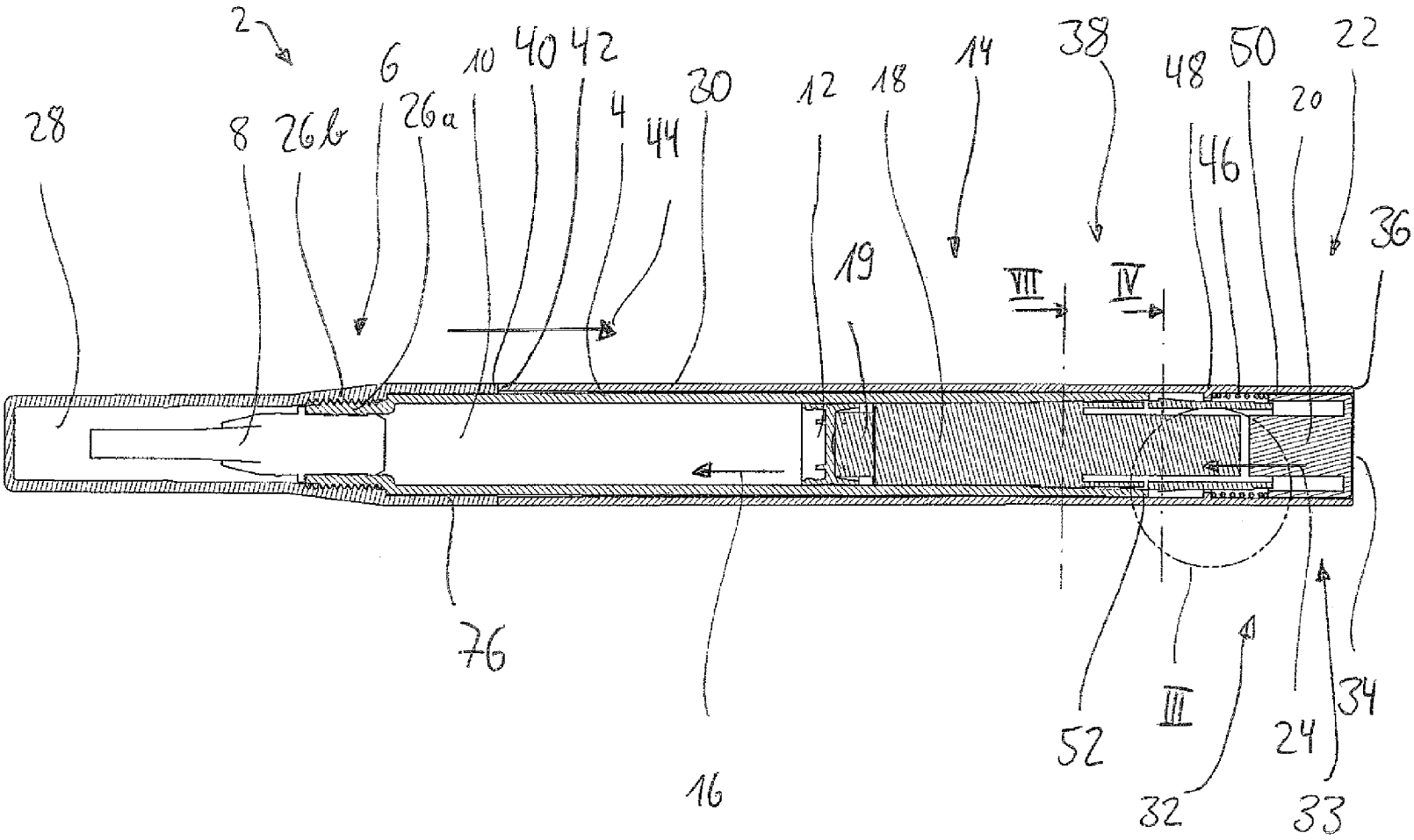
FIG. 1 is a diagrammatic, sectional view of an applicator, with a cap placed on and a protective device in a protective position according to the invention.

Referring now to the figures of the drawing in detail and first, particularly, to FIG. 1 thereof, there is shown a pen-like applicator 2, in the example a nail varnish applicator, having a pen shaft 4 that terminates at its first end-face end 6 in an applicator tip 8. Adjoining the applicator tip 8 in an interior of the pen 4 is a reservoir 10 for an application fluid, in the example non-illustrated nail varnish. Adjoining the reservoir 10 in the pen shaft 4 is a piston 12, which may be moved in the direction of arrow 16 by a delivery mechanism 14 that adjoins it, in order to deliver application fluid from the reservoir 10 to the application tip 8.

The delivery mechanism 14 that is illustrated symbolically in FIG. 1 is a twist ratchet mechanism which is operated by a press action button. The delivery mechanism 14 includes a delivery part 18 adjoining the piston 12 and having a plunger 19 and a delivery button 20, which is in the form of a press action button that is located at a second end-face end 22 of the pen shaft 4. The delivery part 18 is fixed in the pen shaft 4 so that it cannot move axially or rotationally in relation thereto. The delivery button 20 may be pushed in, out of its illustrated end position relative to the delivery part 18, in the direction of arrow 24. The relative movement between the delivery button 20 and the delivery part 18 causes the plunger 19 to move stepwise with the piston 12 in the direction of the arrow 16.

In the region of its end 6, the pen shaft 4 is provided with a thread 26*a*, onto which a cap 28 that protects the applicator tip 8 when it is not in use (as shown) is fully screwed by means of its thread 26*b*. In the region adjoining the cap 28, the pen shaft 4 is surrounded by a sheath 30 that extends as far as its end 22 and forms a protective device 32 for the press action button 20.

In FIG. 1, the sheath 30 is in its protective position 38, in which it fully surrounds the delivery button 20 by its end section 33 that faces the end 22, or in other words has the delivery button 20 received or recessed inside it. In particular, in this way an end-face actuating surface 34 of the delivery button 20 is delimited by an abutment surface 36, namely the end of the end section 33.

In the illustrated non-actuated condition of the press action button 22, the abutment surface 36 is in the axial region of the actuating surface 34. If a user or an article inadvertently presses against the end 22 of the applicator 2, the pressure is taken up by the abutment surface 36 and the actuating surface 34 is prevented from being pressed in. The delivery mechanism 14 is not triggered, and application fluid is not inadvertently delivered to the applicator tip 8.

In FIG. 1, the sheath 30 is held in the illustrated protective position 38 by the placed-on cap 28: an end-face abutment surface 40 thereof, which is located at the open end, presses against an abutment surface 42 of the sheath 30, which faces it and is also an end-face surface, and this keeps the sheath 30 in the protective position 38 in the direction of arrow 44, that is in the axial direction of the applicator 2. At the same time, the sheath 30 is pre-tensioned in opposition to the direction of the arrow 44 by a spring 46. The latter is supported between a radially inwardly integrally formed annular intermediate floor 48 of the sheath 30 and an abutment surface 50 of the delivery button 20.

Figure 2:
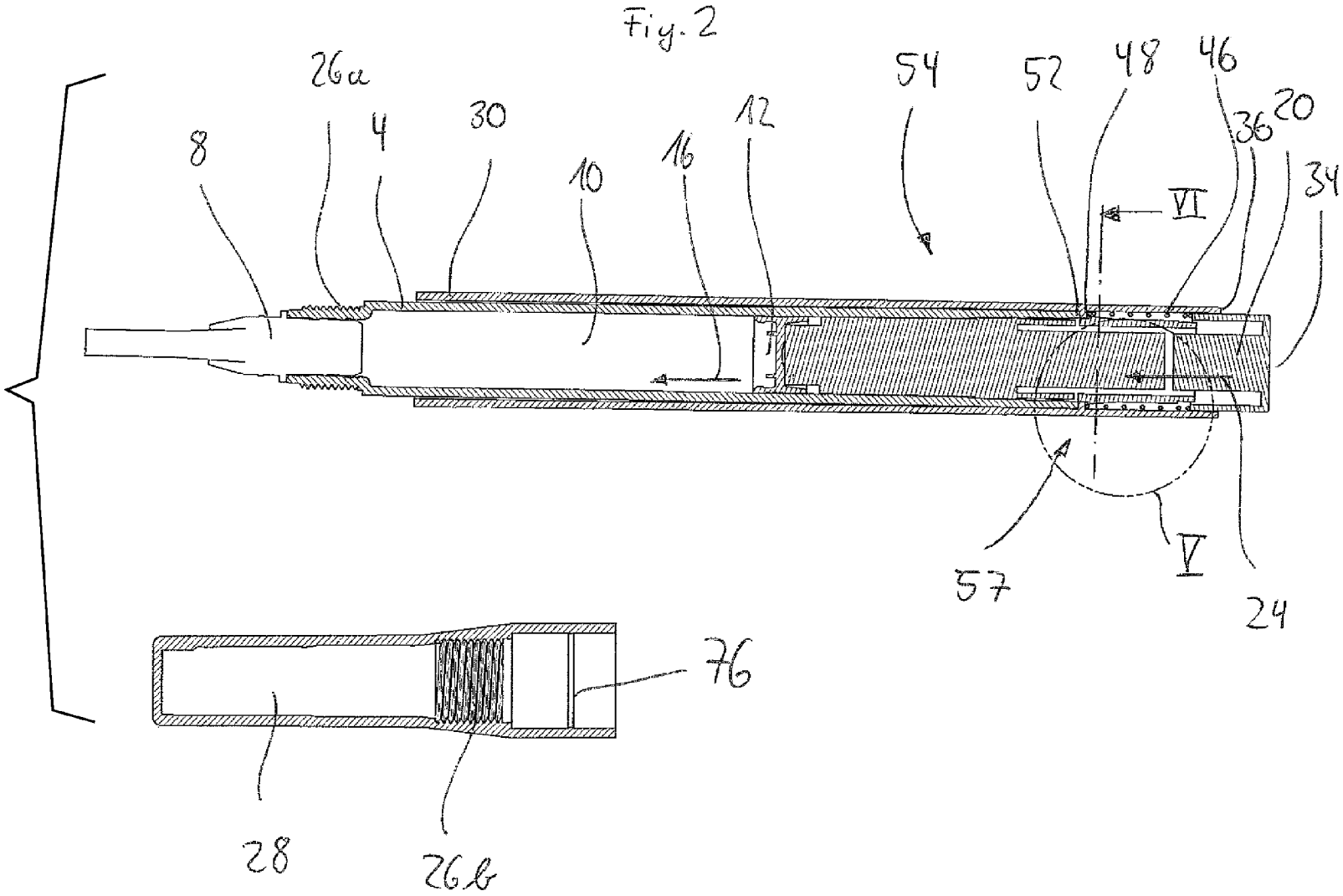
FIG. 2 is a diagrammatic, sectional view of the applicator from FIG. 1, with the cap removed and the protective device in a release position.

For the applicator 2 to be usable, it has to be moved out of its non-use position, as shown in FIG. 1, into the position of use that is shown in FIG. 2. For this, the applicator 2 is held by the sheath 30 and the cap 28 is unscrewed from the pen shaft 4. Because of the threads 26*a, b*, during unscrewing the abutment surface 40 moves in relation to the pen shaft 4, in opposition to the direction of the arrow 44. Because of the spring 46, the sheath 30 is also displaced in relation to the pen shaft 4, in opposition to the direction of the arrow 44, following the cap 28. In other words, the delivery button 20 is released in a successive manner, since it projects out of the end section 33. The relative movement between the sheath 30 and the pen shaft 4 ends in the position shown in FIG. 2, when the intermediate floor 48 in fact abuts against the end-face end or the abutment surface 52 of the pen shaft 4. The threads 26*a, b* are still in engagement here. Then, the cap 28 is unscrewed completely from the thread 26*a, b*, during which the abutment surfaces 40 and 42 move away from each other and finally the cap 28 can be entirely removed from the pen shaft 4.

In FIG. 2, the applicator 2 is ready for operation, that is to say that with the aid of the applicator tip 8 application fluid can be applied, for example nail varnish can be applied to a fingernail. The delivery mechanism 14 is also now ready for operation, since the sheath 30 and the protective device 32 are now in a release position 54. The abutment surface 36 of the sheath 30 is in fact now sufficiently far away from the actuating surface 34 of the delivery button 20 for pressure on the actuating surface 34 to be capable of being performed unhindered, that is to say that the delivery button 20 can be pressed in, in the direction of the arrow 24, to actuate the delivery mechanism 14. Here, the spring 46 fulfills a second, or dual, function: it pre-tensions the delivery button 20 in opposition to the direction of the arrow 24 in relation to the delivery part 18, by way of the sheath 30 and the pen shaft 4. After pressure on the actuating surface 34 and movement of the delivery button 20 in the direction of the arrow 24, the delivery button 20 springs back into the illustrated end position in opposition to the direction of the arrow 24.

When the delivery button 20 is actuated, the applicator 2 is typically not held at the free part of the pen shaft 4 but by the sheath 30. Because of the axially movable mounting of the sheath 30 on the pen shaft 4, pressure on the delivery button 20 would now result—in the absence of further measures—in moving the entire rest of the applicator 2 in the sheath 30 but not in actuating the delivery mechanism 14. For this reason, a locking device 56 is further provided in the applicator 2, and in the position of use shown in FIG. 2 this is in a fixing position 57 and fixes the sheath 30 and the pen shaft 4 axially to one another.

Figure 3:
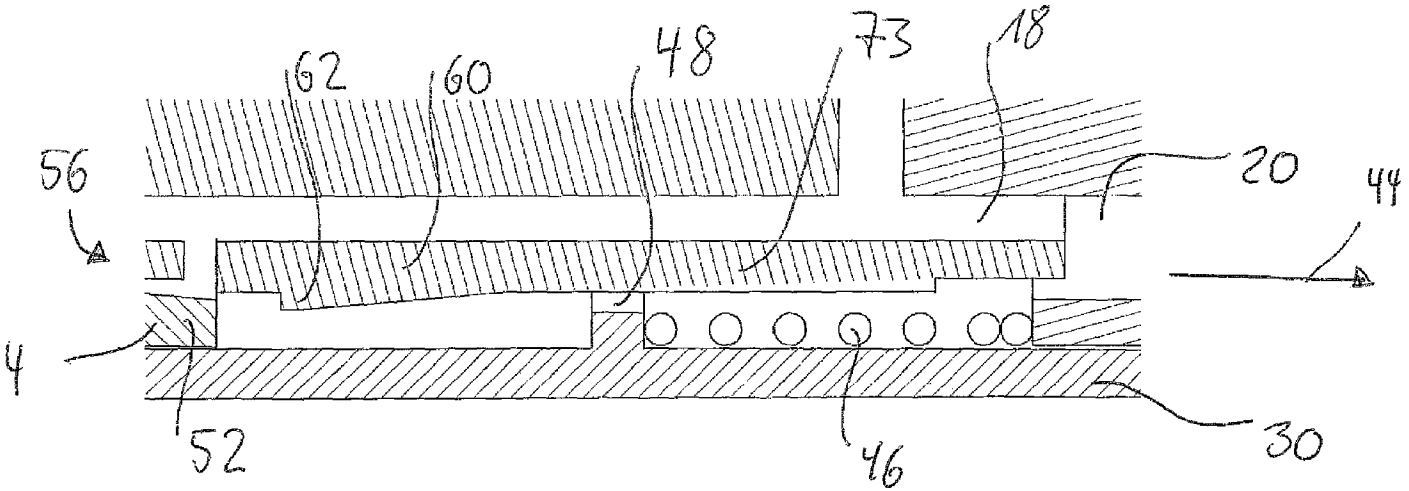
FIG. 3 is a diagrammatic, sectional view showing detail III from FIG. 1.
Figure 4:
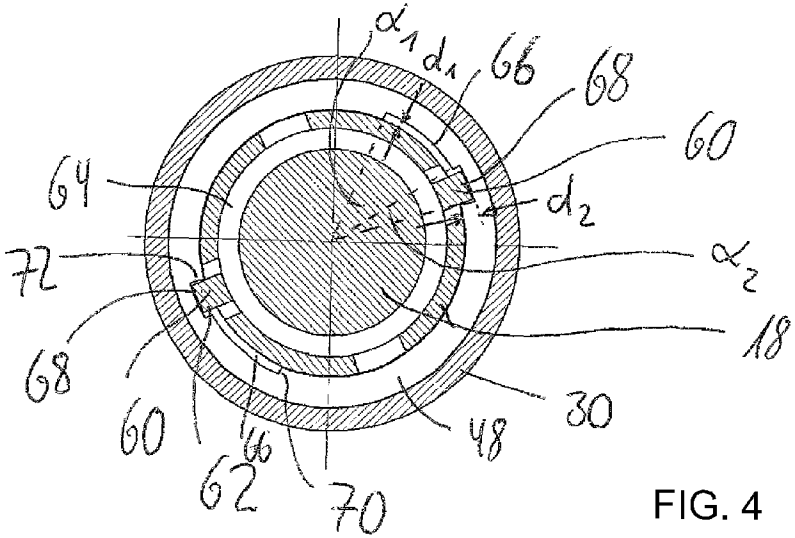
FIG. 4 is a diagrammatic, sectional view showing section IV through the applicator in FIG. 1.

The locking device 56 is illustrated in detail in FIGS. 3 to 6 and 9. In FIGS. 3 and 4, which show the protective position 38 according to FIG. 1, the locking device 56 moves freely, that is to say locking is not effective. The pen shaft 4 and with it the delivery part 18 is thus axially displaceable in the direction of the arrow 44 in order that the illustrated non-use position and the associated protective position 38 can be abandoned when the cap 28 is unscrewed.

The locking device 56 includes a web 60, which is integrally formed on the delivery part 18. One end of the web 60 is cut free on three sides from the wall of the delivery part 60, so that a radially inwardly resilient free end 58 is formed. At its radially outer side, the web 60 carries in the region of the free end 58 a latching nose 62. The locking device 56 moreover includes the intermediate floor 48 against which the latching nose is supported in the release position 54.

In the axial region of the web 60 or its free end, the delivery part 18 has an air gap 64 in order to enable the free end 58 to yield radially inward by the latching nose 62. The locking device 56 further includes: a first groove 66, made in the intermediate floor 48 and having a first depth d1 and extending over a first angular region α1; and a second groove 68 that adjoins the first and has a greater depth d2 and extends over an angular region α2. In the illustrated protective position 38, the pen shaft 4 or the delivery part 18 and the sheath 30 are in a rotary position in relation to one another such that the web 60 lies in the angular region α2 and is thus flush with the groove 68, which has sufficient depth d2 for the latching nose 62 of the web 60 to pass the intermediate floor 48 in both axial directions without their engaging with one another. Thus, the groove 68 forms an aperture for the locking web in the form of the web 60. The two grooves 66 and 68 are thus stepped.

Figure 5:
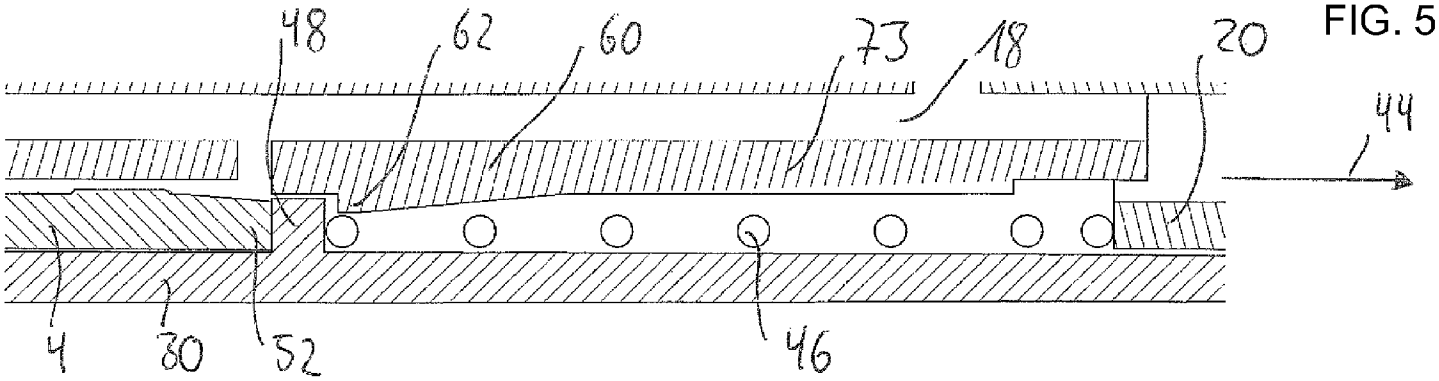
FIG. 5 is a diagrammatic, sectional view showing detail V from FIG. 2.
Figure 6:
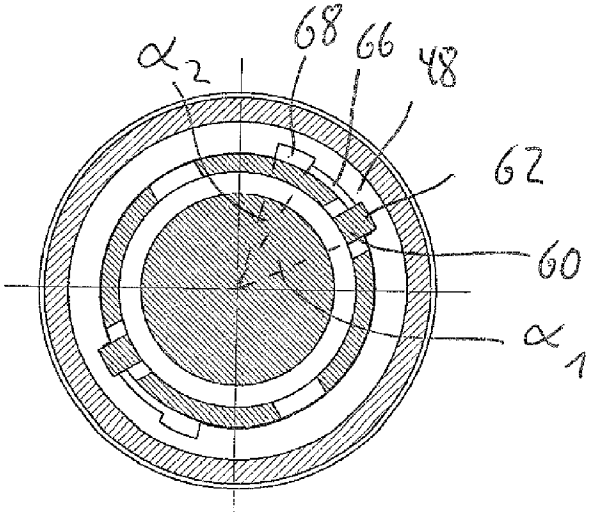
FIG. 6 is a diagrammatic, sectional view showing section VI through the applicator in FIG. 2.

In contrast, FIGS. 5 and 6 show the locking device 56 in its effective, which is fixing, position. The sheath 30 and intermediate floor 48 on the one hand and the delivery part 18 and pen shaft 4 on the other are in this case located in a different rotary position in relation to one another. The web 60 is in fact now in the angular region α1, which is to say in the region of the groove 66 having the smaller depth d1. The latching nose 62 thus reaches behind the intermediate floor 48 and abuts against it, thus preventing the pen shaft 4 and the delivery part 18 from being movable within the sheath 30 in opposition to the direction of the arrow 44. It can further be seen from the detail illustration how the sheath 30 abuts by means of its intermediate floor 48 against the abutment surface 52 of the pen shaft 4. A press action on the delivery button 20 thus results in the latching nose 62 abutting against the intermediate floor 48, the delivery part 18 consequently being supported against the sheath 30, and further press action on the delivery button 20 resulting in a relative movement thereof in relation to the delivery part 18, in opposition to the direction of the arrow 44.

In conjunction with the web 60, moreover, the lateral outer end 70 of the groove 66 and the opposing end 72 of the groove 68 bring about bring about a delimitation of the angle of rotation between the pen shaft 4 and the sheath 30 to the sum of the angular regions α1 and α2. The web in fact also has a height in its fixed section 73 which is greater than the internal clearance between the delivery part 18 and the intermediate floor 48 outside the angular regions α1 and α2.

In an alternative embodiment that is not illustrated, the angular regions α1 and α2 may moreover each be made significantly larger, which results in an overall greater degree of twisting between the sheath 30 and the pen shaft 4 and a greater degree of operational security, since both the latching of the latching nose 62 and the passage of the web 60 through the groove 68 are more reliable, that is to say are ensured over a larger peripheral angle.

Figure 7:
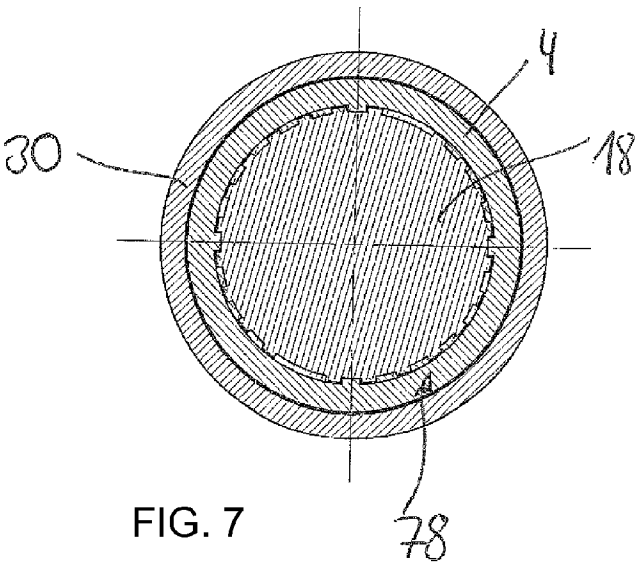
FIG. 7 is a diagrammatic, sectional view showing section VII through the applicator in FIG. 1.

FIG. 7 shows how, with the aid of various webs, which are not shown individually, whereof the teeth engage in one another and which form a rotation prevention device 78, the delivery part 18 and the pen shaft 4 are fixed to prevent rotation in relation to one another. However, as explained above, the sheath 30 may be twisted in relation to both parts.

Figures 8A, 8B, 8C, 8D:
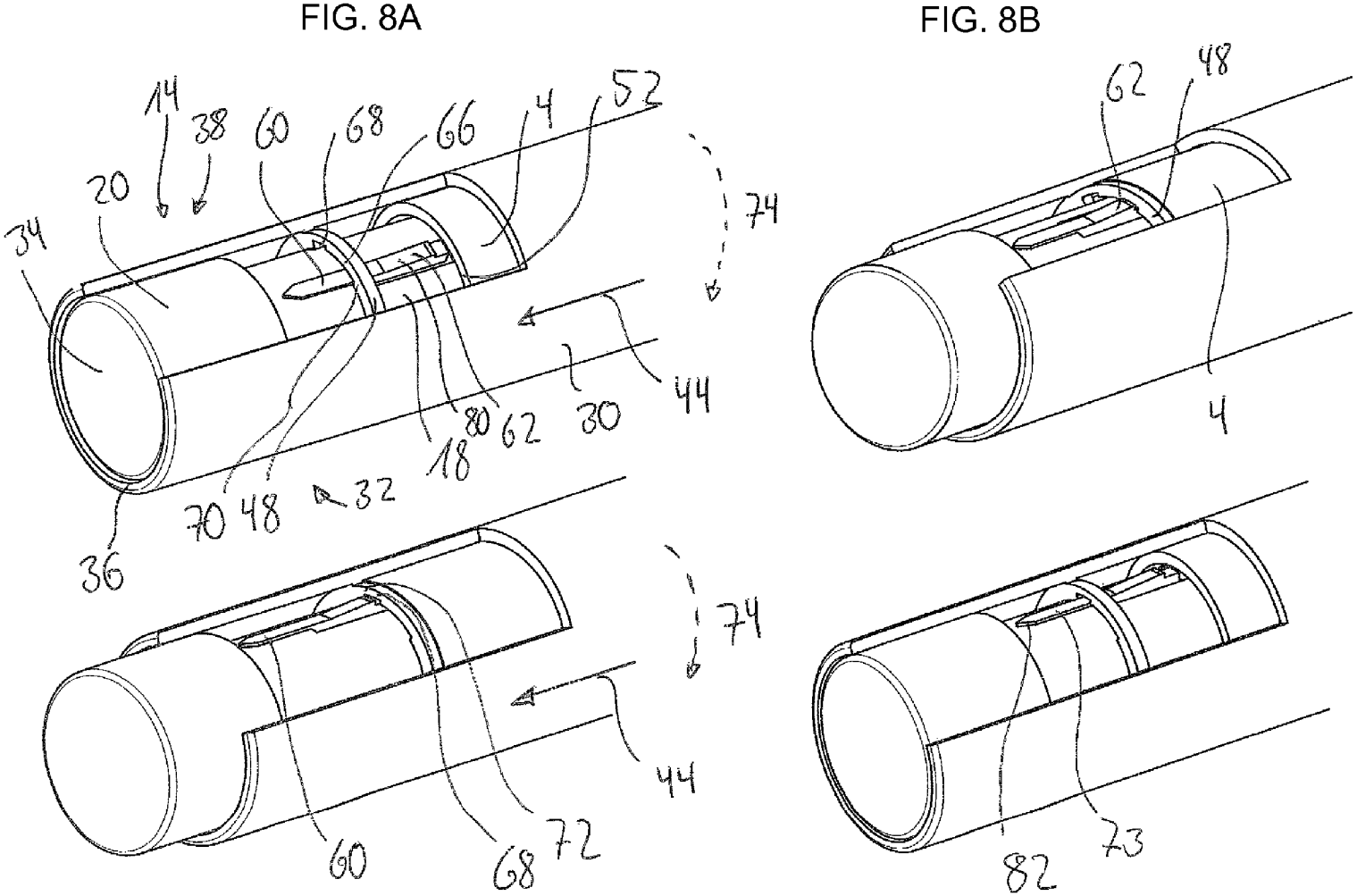
FIGS. 8A-8D are diagrammatic, perspective views of the applicator from FIG. 1, in different operational conditions of the locking device.
Figures 9, 10:
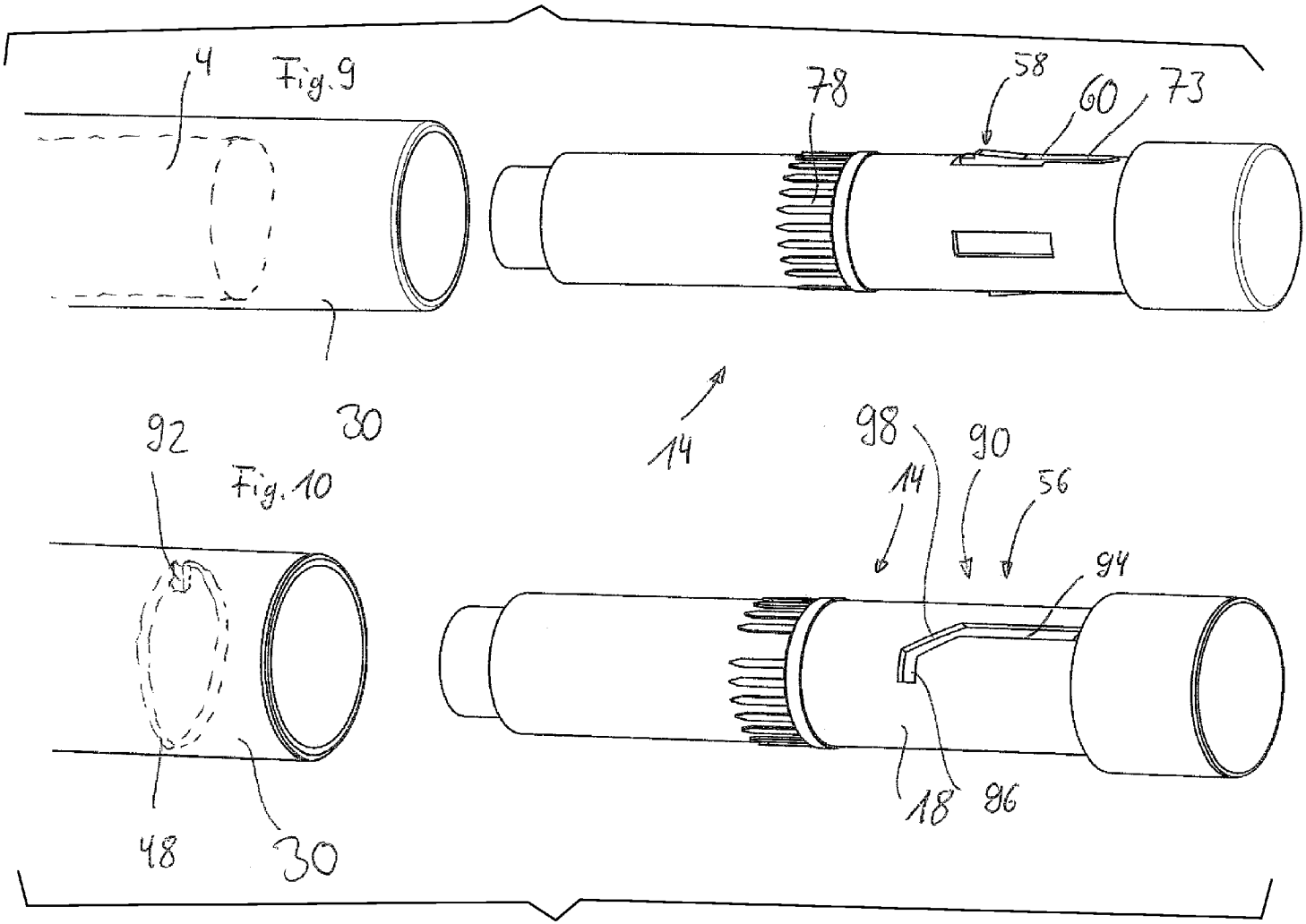
FIG. 9 is a diagrammatic, perspective view showing the applicator from FIG. 1 in a partially dismantled state.
FIG. 10 is a diagrammatic, perspective view showing the applicator having an alternative locking device in a partially dismantled state.

FIGS. 8A-8D show in four steps how the movements of both the locking device 56 and the protective device 32 are coupled to the removal of the cap 28 from the applicator 2 and the placing on thereof. FIG. 8A shows the protective device 32 in the protective position 38, albeit with unscrewing, that is to say removal of the cap 28 from the applicator 2, just beginning. The applicator 2 is held by the sheath 30 and the cap 28 is unscrewed by rotating it in the direction of the arrow 74. Because the cap 28 has a radially inward annular bead 76, which is particularly clearly visible in FIG. 2 and which abuts with frictional connection (see FIG. 1) against the pen shaft 4, the rotary movement of the cap 28 results in entrainment of the pen shaft 4 and, because of the rotation prevention device 78, also of the delivery part 18 in relation to the sheath 30, in the direction of the arrow 74. The annular bead 76 thus brings about a frictional connection between the cap 28 and the pen shaft 4. The annular bead 76 moreover has a dual function as a sealing element that, when the cap 28 is placed on, seals the latter from the environment around the pen shaft 4 and so prevents the application tip 8 from drying out.

Thus, the web 60 leaves the region of the groove 68, which is the angular region α2, and enters the angular region α1 of the groove 66 until it abuts against the end 70. Moreover, unscrewing the cap 28 at the same time starts the pen shaft 4 and the delivery mechanism 14 moving in the direction of the arrow 44 in relation to the stationary sheath 30. The web 60 slides through the groove 66 and, thanks to a run-up ramp 80, yields resiliently inward, with the result that the latching nose 62 passes completely through the groove 66. For this purpose, the run-up ramp 80 lies on the side of the latching nose 62 that faces the end 22.

Finally, as shown in FIG. 8B, the latching nose 62 and the free end 58 spring back outward and the latching nose 62 reaches behind the intermediate floor 48. Thus, FIG. 8B shows the position of use of the applicator 2, which is shown in FIG. 2. The locking device is in the fixing position 57.

FIG. 8C shows the beginning of screwing on, that is to say placing on of the cap 28. Because of the friction of the annular bead 76 against the pen shaft 4, the pen shaft 4 and the delivery mechanism 14 are now twisted in relation to the sheath 30 in opposition to the direction of the arrow 74. Twisting terminates in the position that is illustrated in FIG. 8C, when the web 60 abuts by means of its section 73 against the end 72 of the groove 68. At the same time, screwing on the cap 28 results in a movement of the pen shaft 4 and so on in opposition to the direction of the arrow 44. Because in particular the latching nose 62 is now in the angular region α2, it can pass the intermediate floor 48 through the groove 68, because of the greater depth d2, with the result that at the end of the screwing-on procedure the applicator finally reaches the end position, which is shown in position 8*d* and corresponds once more to FIG. 1.

The tip 82, shown in the figures, at the end of the web 60 facing the end 22 serves to introduce the web into the angular regions α1 and α2 during assembly of the applicator 2.

FIG. 9 once again shows, in a perspective illustration, the sheath 30 with the pen shaft 4 inside it, which is indicated by dashed lines, and the delivery mechanism 14 with the rotation prevention means 78 and the webs 60.

FIGS. 10 to 17 show an applicator according to FIGS. 1 to 9, but with an alternative locking device 56. Here, the delivery mechanism 14 and the delivery part 18 have no web 60 but instead a control cam 90, which is formed by a cutout in the wall of the delivery part 18. In addition, the intermediate floor 48 has no grooves 66 and 68 but instead a guide pin 92 that projects radially inward out of the intermediate floor and engages in the control cam 90. The control cam 90 has an axially extending axial section 94 that faces the end 22, an oblique section 98 that adjoins the axial section 94 and extends obliquely at approximately 45° to the axial direction, and a transverse section 96 which in turn adjoins the oblique section 98 and extends in the peripheral direction.

FIG. 11 shows the alternative applicator 2 in a manner corresponding to FIG. 1, with the protective device 32 in the protective position 38. The guide pin 92 is located axial section 94 and thus allows an axial movement between the sheath 30 and the pen shaft 4 etc. Thus, the locking device 56 is unlocked.

FIG. 12 illustrates the alternative applicator 2 in a manner corresponding to FIG. 2, with the protective device 32 in the release position 54; the protective device 32 is located in the release position 54. The guide pin 92 is now in the transverse section 96. As a result, the sheath 30 and the pen shaft 4 etc. are axially fixed in relation to one another. Thus, the locking device 56 is locked.

In this embodiment too, the guide pin 92 is moved in the control cam 90 or the axial section 94 thereof by the resilient axial movement of the sheath 30 when the cap 28 is screwed on and unscrewed. As a result of the friction between the annular bead 76 and the pen shaft 4, the rotary movement of the cap 28 moreover has the effect of passing through the oblique section 98 and, finally, as unscrewing of the cap continues, the guide pin 92 is displaced into the transverse section 96. As a result of the oblique section 98, when the cap 28 is screwed on or unscrewed from the applicator 2, a smooth transition or simple change of the guide pin 92 from the axial section 94 to the transverse section 96 becomes possible. FIGS. 15 and 16 show again what has just been described, in detail illustrations. FIGS. 13 and 14 show, again in section, the position of the guide pins 92 in the axial section 94 and the transverse section 96.

Figures 13, 14, 17:
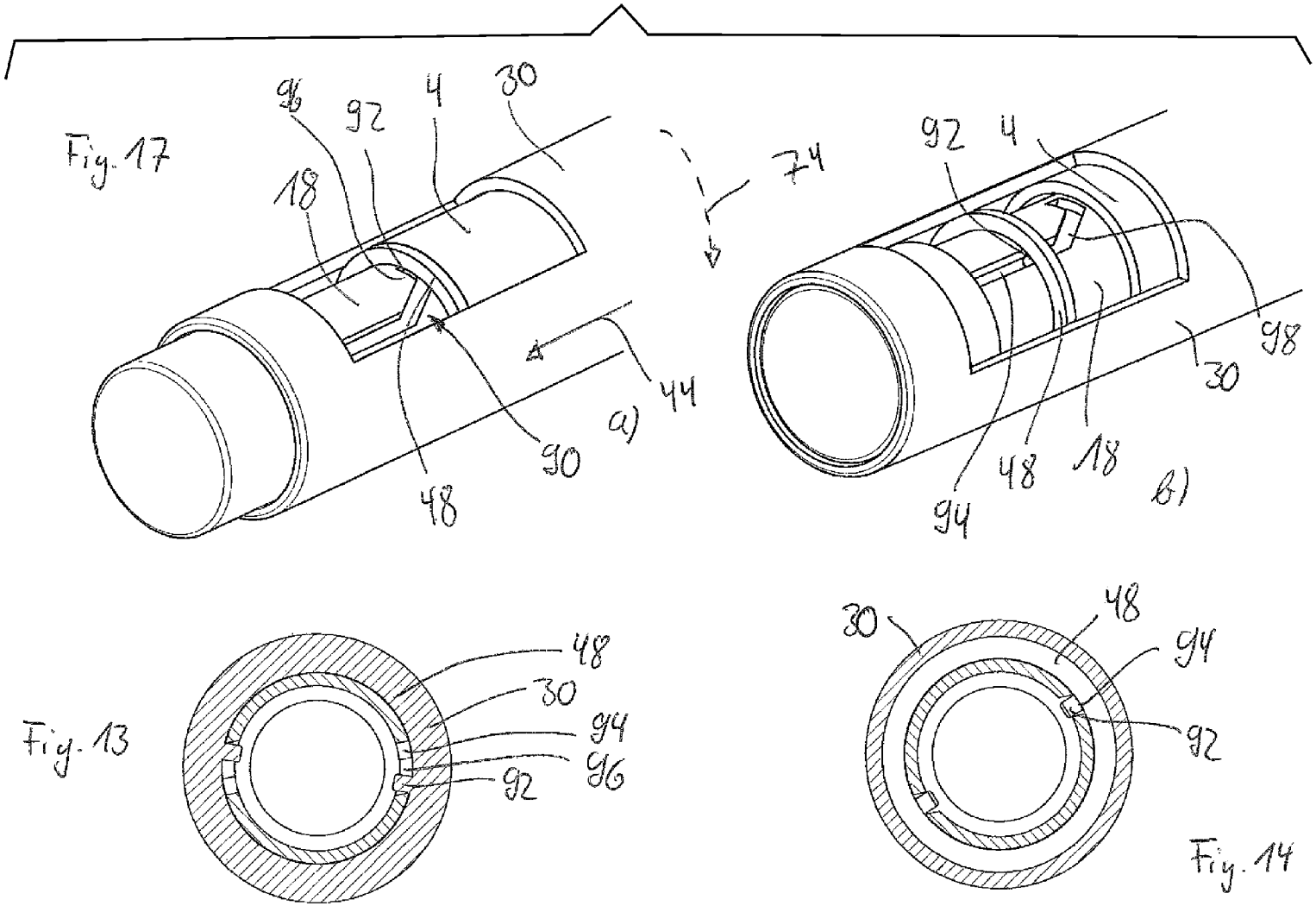
FIG. 13 is a diagrammatic, sectional view showing section XIII through the applicator in FIG. 12.
FIG. 14 is a diagrammatic, sectional view showing section XIV through the applicator in FIG. 11.
FIG. 17 is a diagrammatic, perspective view of the applicator from FIG. 10 in different operational conditions of the locking device.

FIG. 17 shows, starting from the illustrated position of FIG. 8A, which is the position of use of the applicator 2, how screwing on the cap 28 in opposition to the arrow 74 with the sheath 30 held stationary means that the pen shaft 4 is entrained, with the delivery part 18, in the sheath 30 in opposition to the arrow 74. Thus, the guide pin 92 slides first of all in the transverse section 96, in the direction of the arrow 74. As it moves further through the oblique section 98, axial movement of the pen shaft 4 and the delivery mechanism 14 within the sheath 30 begins in opposition to the direction of the arrow 44, and this results in a combined rotary and axial movement. Finally, the guide pin 92 slides into the axial section 94 and rotary movement is terminated. The axial movement continues until the position shown in FIG. 8B has been attained, once the cap 28 has been completely screwed onto the applicator 4.

The invention claimed is:

1. A pen-like applicator, comprising:

a pen shaft having a first front end and a second rear end disposed opposite said first front end, said pen shaft further having a reservoir for storing an application fluid;

an applicator tip disposed at said first front end;

a removable cap disposed at said first front end;

a delivery button disposed at said second rear end and acting on said reservoir storing the application fluid; and a protective device that, when said removable cap is placed on, is disposed in a protective position and prevents said delivery button from being actuated and whereof movement is coupled to that of said removable cap such that when said removable cap is removed said protective device is in a release position in which said protective device releases said delivery button for actuation.

2. The applicator according to claim 1, wherein said protective device has a sheath that may be displaced in a axial direction of the applicator and in the protective position surrounds said delivery button concentrically.

3. The applicator according to claim 2, wherein:

said delivery button has an end face with an actuating surface; and said sheath has an end face with an abutment surface and, in the protective position, said abutment surface is disposed axially in a region of said actuating surface.

4. The applicator according to claim 3, further comprising a locking device axially fixing said sheath and said pen shaft to one another in a fixing position.

5. The applicator according to claim 4, wherein said locking device may be locked in the fixing position as a result of a relative rotation between said pen shaft and said sheath and released therefrom.

6. The applicator according to claim 5, wherein the relative rotation is caused by a frictional connection means between said removable cap and said pen shaft.

7. The applicator according to claim 4, wherein said locking device contains an intermediate floor, disposed on said sheath and projects radially inward, and a locking web disposed on said pen shaft, in which, over an angular region of a periphery, said intermediate floor has an aperture formed therein for said locking web.

8. The applicator according to claim 7, wherein said locking web has a latching nose, and at least in a region thereof takes a form of a radially inwardly resilient free end and has a ramp, which faces said second rear end, for said intermediate floor to run up.

9. The applicator according to claim 2, wherein said sheath extends axially from said placed-on removable cap to said second rear end.

10. The applicator according to claim 2, wherein said sheath is resiliently pre-tensioned in relation to said pen shaft in a direction of said removable cap, in which said removable cap and said pen shaft each have a thread and said removable cap and said sheath have abutment surfaces by way of which, when said removable cap is placed on, said sheath abuts against said removable cap.

11. The applicator according to claim 10, further comprising a spring supported between said delivery button and said sheath.

12. The applicator according to claim 10, further comprising a control cam secured to said pen shaft, said control cam having a transverse section facing said first front end and an axial section facing said second rear end; and wherein said locking device has a guide pin on said sheath, and said guide pin engages in said control cam.

13. The applicator according to claim 12, wherein said control cam has an oblique section that lies between said transverse section and said axial section.

* * * * *